US005332014A

United States Patent [19]

Feig

[11] Patent Number: 5,332,014

[45] Date of Patent: Jul. 26, 1994

[54] CONTROLLED-RELEASE SOAP DISPENSER

[75] Inventor: Steven J. Feig, Dix Hills, N.Y.

[73] Assignee: Cleanse Tec Division of F&N Chemical Co., Inc., Brooklyn, N.Y.

[21] Appl. No.: 973,075

[22] Filed: Nov. 6, 1992

[51] Int. Cl.[5] ..... B65B 1/04; B65B 3/04

[52] U.S. Cl. ..... 141/110; 222/478; 239/315; 239/316; 252/93

[58] Field of Search ..... 141/18, 110, 391; 4/222, 227.1, 222.1; 222/651, 652, 169, 457.5, 477, 478, 480, 565; 239/315, 316; 446/15; 252/92, 93

[56] References Cited

U.S. PATENT DOCUMENTS 2,776,787 1/1957 Nicol ..... 222/565

4,703,872 11/1987 Cornette et al. ..... 222/478

FOREIGN PATENT DOCUMENTS 25754 of 1913 United Kingdom ..... 239/316

*Primary Examiner*—Henry J. Recla

*Assistant Examiner*—Steven O. Douglas

*Attorney, Agent, or Firm*—Cohen, Pontani, Lieberman, Pavane

[57] ABSTRACT

A device and method for the controlled release of a soapy water concentrate into a sink or basin for providing a sink full of soapy water for institutional pot, pan and dishwashing applications. The device is implemented as a container filled with semi-solid, water-soluble soap concentrate. The container has a base which allows it to freely stand at the bottom of the sink being filled with water. A stream of water from a sink faucet is directed into an inlet aperture on an upper surface of the container. The water enters the inlet aperture, commingling and interacting with the semi-solid soap to dissolve a fractional portion thereof and form a soapy water concentrate solution. The solution is ejected under pressure by the entering water out through a plurality of outlet apertures defined in the container, thereby filling the sink with soapy water concentrate. Water is directed into the inlet aperture until the water level of the sink rises to or above the level of the inlet aperture, whereupon the container may be removed from the sink and plain water is permitted to fill the sink to a desired level, diluting the soapy water concentrate solution to a degree suitable for institutional pot, pan and dishwashing applications. Formation of the soapy water concentrate is self-terminating since, once the water level in the sink rises above the inlet aperture, water is no longer forced under pressure into the inlet aperture and the formation of soapy water concentrate within the container diminishes to a negligible level.

25 Claims, 3 Drawing Sheets

CONTROLLED-RELEASE SOAP DISPENSER

FIELD OF THE INVENTION

The present invention relates to an apparatus and method for controllably releasing a predeterminately appropriate amount of soapy water concentrate into a dishwashing sink as the sink is filled with water. The device provides a simple, economical and virtually waste-free method of introducing detergent into a dishwashing sink for institutional dishwashing applications, most typically the cleansing of pots and pans.

BACKGROUND OF THE INVENTION

The general principle of introducing soaps and detergents in controlled amounts into wash water is known. Typically, known techniques for introducing controlled amounts of soap into wash water require the use of judgment on the part of the person filling the sink, a generally unsatisfactory standard since this can lead to insufficient amounts of soap being added to the water to perform the task successfully or, alternatively, to an oversupply of the wash-water with soap, thereby leading to waste. Common devices such as pump-type applicators, squeeze bottles, and measuring cups, in addition to being quite messy, also rely on the judgment of the user for dosage control and are likewise unsatisfactory.

U.S. Pat. No. 4,703,872 to Cornette, et al. and U.S. Pat. No. 4,893,726 to Vesborg disclose devices for dispensing detergent compounds into the wash water of a clothes washing machine. Such devices rely on total and continued immersion in the washing machine during agitation for the release of clothes washing detergent, typically in liquid form. Such devices possess the disadvantage of requiting opening and refilling with soap after each use, and are not suitable for institutional dishwashing since in dishwashing sinks the level of agitation is minimal as compared to a clothes washing machine.

Also known is a detergent container as described in U.S. Pat. No. 5,086,952 to Kryk. The Kryk apparatus comprises an inverted container which may be filled with detergent pellets, briquettes or the like. The container is placed outside of the sink to be filled with soap. When it is desired to fill a sink or other basin with soap, a water spray is introduced through a mesh grid in the bottom of the container, which spray dissolves the soap pellets in the container, causing soapy liquid to fall from the container into the sink being filled. This device requires a special external sink mounting and water feed, all of which greatly complicates its use, and also requires some degree of user judgment in determining the duration of water spray which is allowed to impinge upon the soap pellets while filling the sink.

It would therefore be highly desirable to provide a simple-to-use device and method for filling a sink with a required amount of soap, which requires a minimum of user judgment, minimizes waste, and leaves no messy residue around the work area.

SUMMARY AND OBJECTS OF THE INVENTION

The present invention is directed to a device and method for filling a sink or other basin with soapy water concentrate in a controlled, economical and tidy fashion.

The device comprises a container filled with a malleable, water-soluble, semi-solid detergent concentrate. The container is free-standing, having a substantially flat base which is so formed as to allow the container to stand on its base in the bottom of a sink or basin as the sink is filled. On an upper surface of the container there is formed an inlet aperture through which is directed a flow or stream of fill water from a water supply such as a faucet, hose or spigot. The water enters the inlet aperture and impinges upon the semi-sold soap within the container, commingling with the soap and causing it to dissolve and forming a soapy water concentrate. Surrounding the inlet aperture, preferably in a generally concentric, circular configuration, are a series of outlet apertures which may be formed in the upper surface of the container or about the sidewall of the container proximate the container top. The soapy water concentrate formed by the commingling of the feed water and the semi-solid soap is ejected from the container through these outlet apertures into the sink, thereby generally filling the sink with soapy water concentrate. The division of water flow from a single inlet through multiple outlets minimizes backsplash and advantageously provides a relatively uniform distribution of the soapy water concentrate in the sink.

The device remains in the sink, with the fill water stream from the faucet directed through the inlet aperture, until such time as the soapy water concentrate level in the sink rises to the level of the top of the container. At that time, the device is removed from the sink, while the fill water is allowed to fill the sink to its desired water level. The device is so configured so that a proper amount of soapy water concentrate is released during the period of time it takes for the water level in the sink to rise to the top of the container, and so that, after optional removal of the device from the sink, continued filling of the sink with plain water to a desired working level yields a proper soap concentration in the wash water.

Upon removal from the sink, excess water is allowed to drain from the device through the apertures, and the device may be neatly stored until the next sink-filling procedure is required. The user never comes in contact with the soap, nor is any significant judgment required during use, since once the level of water exceeds the height of the top of the container, water is no longer forcefully fed through the inlet aperture and the formation of additional soapy water concentrate is thereafter negligible. Therefore, even if the device were to be left in the sink, it would result in no significant oversupply or waste.

It is therefore an object of the present invention to provide a device and method for economically providing the proper amount or volume of soapy water concentrate to a sink or basin for institutional dishwashing applications, most commonly pot and pan washing.

It is a further object of the invention to provide a device and method for economically providing the proper amount of soapy water concentrate to a sink or basin for institutional dishwashing applications which is simple to use and requires little or no user judgment in its application, thereby virtually eliminating waste.

It is a still further object of the invention to provide a device and method of filling an institutional dishwashing sink such that the user has no direct contact with the soap compounds used to form the soapy water concentrate.

It is a still further object of the invention to provide a device which requires no refilling after each use and which, when empty, may be readily disposed of.

It is a yet further object of the invention to provide a device and method of controllably dosing a dishwashing sink with soapy water concentrate in an essentially self-terminating manner, such that when the proper amount of soapy water concentrate has been introduced into the sink, the formation and further introduction of soapy water concentrate into the sink essentially ceases.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims.

DETAILED DESCRIPTION OF THE DRAWINGS

In the drawings, wherein like reference characters denote similar elements throughout the several views.

Figure 5:
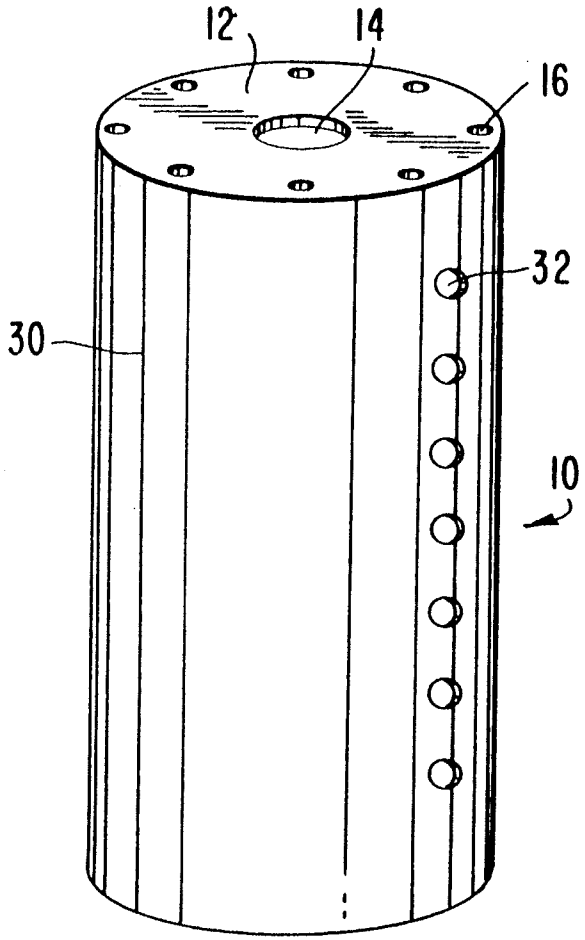
FIG. 5 is an elevated side perspective view of an alternate embodiment of a soap dispenser in accordance with the invention wherein a series of weep holes are disposed vertically along the sidewall of the body of the controlled release dispenser.
Figure 7:
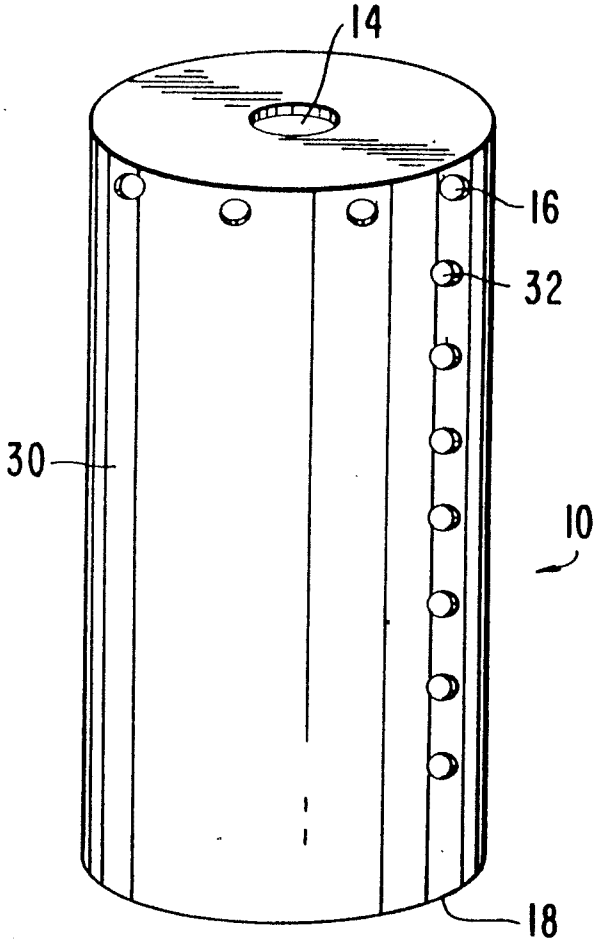
Figure 6:
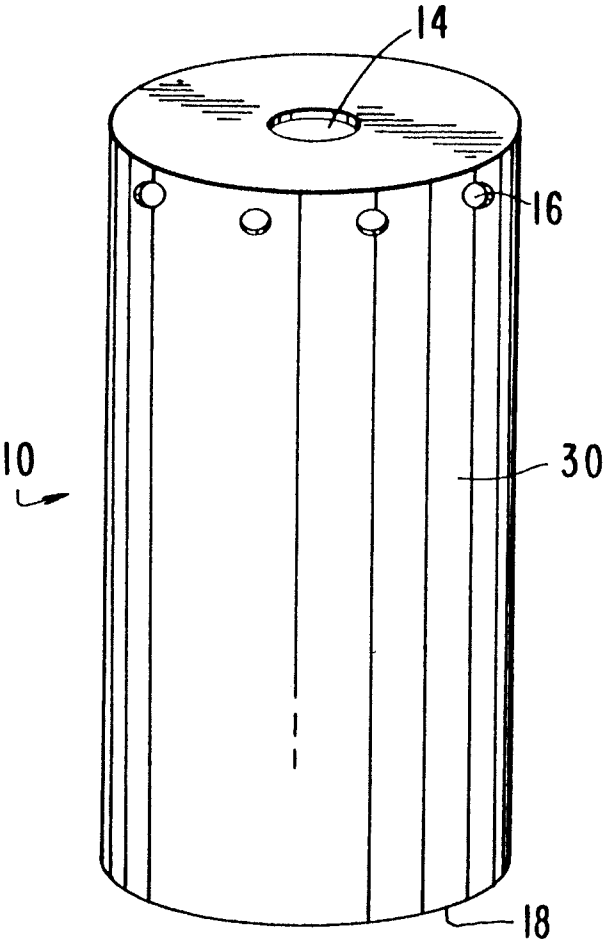

FIG. 6 depicts another alternate embodiment of a soap dispenser of the invention wherein the outlet apertures are positioned circumferentially about the sidewall of the body of the controlled release dispenser proximate the body's top or upper surface; and FIG. 7 depicts still another alternate embodiment including both the weep holes of FIG. 5 and the outlet apertures of FIG. 6 on the sidewall of the body of the controlled release dispenser.

DETAILED DESCRIPTION OF THE PREFERRED EMBODIMENTS

In its broadest sense, the present invention relates to a self terminating, controlled release soap dispenser which may be simply used to dose a sink with a suitable amount of soapy water concentrate. The device is configured as an essentially sealed container which contains a semi-solid soap concentrate. The device is placed in a sink and a source of fill water is directed into the container through an inlet aperture at the top of the container. This inlet water, entering the container under pressure, creates currents within the container, agitating the water in the container against the soap concentrate and causing it to dissolve, thereby creating a soapy water concentrate solution. This solution is ejected from the container by the entry of fill water into the container through the inlet aperture. The formation of soapy water concentrate is a function of the pressure of the water entering through the container—which pressure determines the degree of agitation of the water in the container—and the temperature of the agitated water, both factors influencing the degree to which the semi-solid soap concentrate dissolves to form the soapy water concentrate solution. The device is so configured that creation of this solution is self terminating, since once the level of water in the sink rises sufficiently above the level of the inlet aperture, fill water will no longer enter the container under pressure, the pressure having being dissipated by the volume of water present over the inlet. That being the case, agitation of water in the container essentially ceases, and further dissolving of the semi-solid soap concentrate diminishes to a negligible level. Further filling of the sink will cause dilution of the soapy water concentrate thus far created, such that when the sink is filled to a suitable water level for pot, pan or dish washing, the amount of soap present in the wash water is also at a suitable level. The device may be removed from the sink at any time after the water level rises above the level of the inlet, and its removal, or non-removal, has no significant effect on the proper dosing of the sink with soapy water concentrate.

Figure 1:
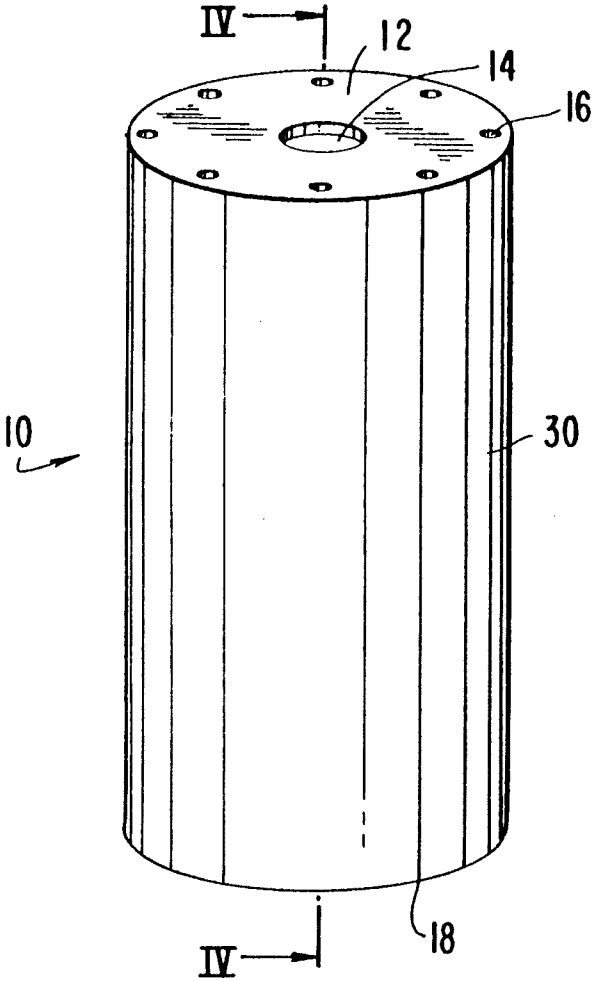
FIG. 1 is an elevated side perspective view of a soap dispensing device constructed in accordance with the teachings of the present invention.

With initial reference to FIG. 1, there is shown a preferred embodiment of a controlled-release soap dispenser constructed as a free-standing, substantially closed, cylindrical container 10 having an upper or top surface 12, a continuous sidewall 30 and an essentially flat bottom or base 18 which allows the container 10 to be placed, free-standing, at the bottom of a sink or other basin which is to be filled with soapy water. In a preferred form of the invention the container 10 is generally cylindrical, although it will be recognized that the container shape is not particularly critical and may be rounded, squared, tapered, or assume any other shape so long as the container is configured to provide a base which allows it to stand freely at the bottom of a sink or basin and an upper surface opposite the base and which can be positioned beneath the outflow stream of water from a source of fill water feeding the sink, typically a faucet.

The container 10 has a top or upper surface 12 through which is formed an inlet aperture 14. The inlet aperture 14 is predeterminately sized to permit a flow of water from a sink faucet to be directed therethrough to reach the interior of the container 10. In a currently preferred embodiment, the inlet aperture has a diameter of approximately 0.75", although it will be readily recognized by those skilled in the art that the size of the inlet aperture may be suitably varied to accommodate streams of water of varying diameters.

Figure 2:
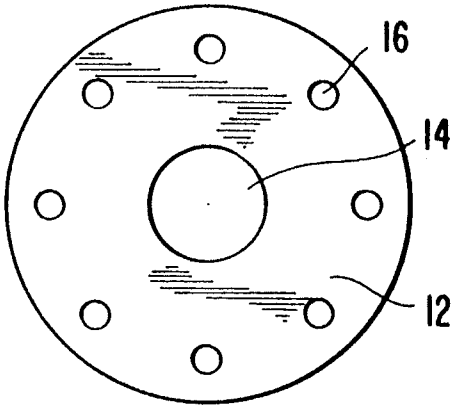
FIG. 2 is a top plan view of the soap dispensing device of FIG. 1 showing a preferred configuration of inlet and outlet apertures.

Also positioned on the upper surface 12 of container 10, as perhaps best seen in FIG. 2, are a plurality of outlet apertures 16. The outlet apertures 16 are preferably positioned in a circumferentially circular pattern, the circular pattern being generally concentric with the peripheral edge of the inlet aperture 14. In a preferred embodiment, as best seen in FIG. 2, there is a single inlet aperture 14 and eight outlet apertures 16, positioned in a circular pattern around the inlet aperture on the upper surface 12 of the container 10.

Figure 4:
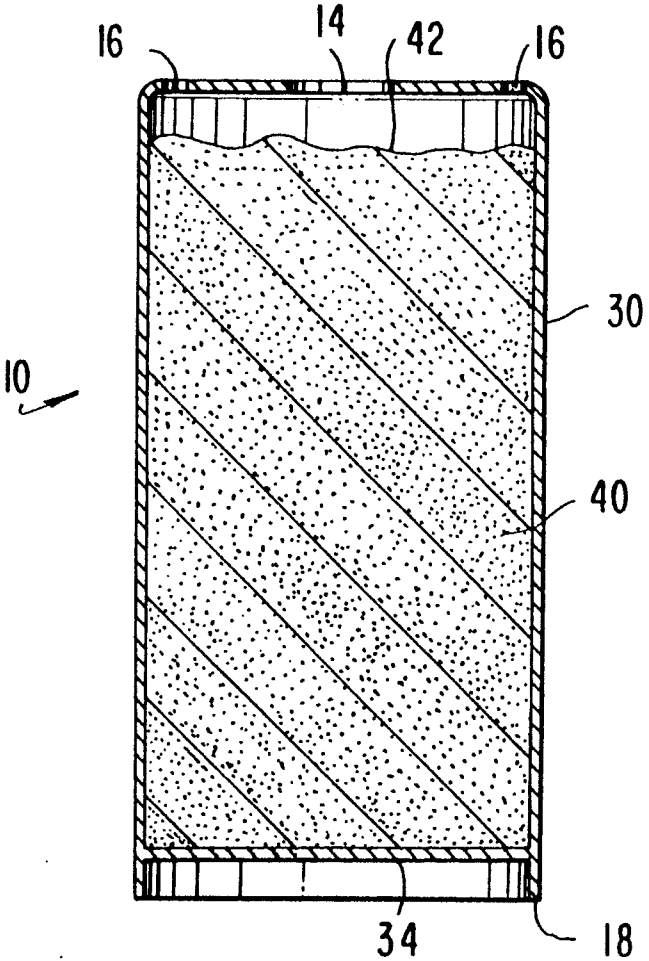
FIG. 4 is a sectional view taken along the lines IV—IV in FIG. 1 and showing the semi-solid detergent concentrate disposed within the inventive controlled release dispenser.

Referring now to FIG. 4, there is seen a sectional view of the container 10 showing the interior of the container filled with a known semi-solid soap concentrate 40. This malleable soap concentrate, also known in the art as semi-solid detergent, or high-density semi-solid detergent, substantially fills the container 10 and, as a resultant property of the semi-solid detergent, remains subtantially affixed to the interior of container 10 by natural adhesion. The soap concentrate is sealed within the substantially closed container 10 by a bottom seal 34 at the bottom of container 10. The semi-solid soap concentrate 40 is of a type particularly well suited for use in institutional dishwashing applications, especially pot and pan washing applications. One type of semi-solid soap concentrate particularly suited for use in the present invention is marketed under the trade name SOLID GOLD, manufactured and sold by CLEANSE TEC of Brooklyn, N.Y. However, it will be recognized by those skilled in the art that other formulations of semi-solid soap concentrate, freely available in the marketplace, may also be utilized within the container 10 providing they have the required dissolution and detergent concentration characteristics required for institutional pot and pan washing applications in accordance with the present invention.

In use, the container 10 is placed at the bottom of the sink or basin to be filled. In a preferred embodiment the container 10 is formed such that the lower edge of the sidewall 30 at the bottom of the container 10 forms a circular, flat base 18 which allows the container to freely stand upright at the bottom of the sink. If desired the base of the container 10 may be so configured as to be completely flat (not shown) or to contain a friction coating (not shown) to prevent unintended movement during use. The container 10 is, more particularly, positioned within the sink beneath the faucet or the like from which the stream of fill water emanates, and so that the stream is directed toward and into the inlet aperture 14. The faucet, hose or spigot which provides fill water to the sink is turned on, set to a desired temperature, and the stream of water is thereby directed into and through the inlet aperture 14. The water entering inlet aperture 14 under pressure forms currents within the container, which causes the water in the container to agitate along the upper soap surface 42 of the semi-solid soap concentrate 40, commingling and interacting therewith to dissolve a fractional part thereof and form a soapy water concentrate solution. This soapy water concentrate solution is forced out of the container 10 through the outlet apertures 16 by the increased pressure generated in the container 10 as new fill water from the faucet feeding the sink enters through the inlet aperture 14. Referring again to FIG. 2, the eight outlet apertures 16 positioned circumferentially about the inlet aperture 14 effectively divide the pressure of the incoming water evenly for controlled distributive dispersal of soapy water concentrate out of the container through outlet apertures 16 with a minimum of splashing. The flow of water from the sink faucet to inlet aperture 14 is allowed to continue, during which time soapy water concentrate, ejected through outlet apertures 16, gradually fills the sink. When the level of soapy water concentrate in the sink rises to a level substantially equal to or greater than the upper surface 12 of the container 10, the container 10 may optionally be removed from the sink, and the sink is allowed to continue to fill normally with plain water from the faucet. The continued falling of the sink with plain water, after such optional removal of the container 10, affects a reduction in the concentration of detergent in the soapy water mixture to a usable working amount or concentration, after which pot, pan or dishwashing may commence in the sink.

Upon optional removal from the sink, the container 10 may be inverted to drain any excess water from the container and the container then placed aside until a fresh supply of soapy water is required, at which time the above-described process is repeated. When all of the semi-sold soap concentrate 40 in the container is used up, the entire container 10 may be discarded.

Of course, the container does not have to be removed as soon as the water level reaches the level of the upper surface of the container, since the formation of soapy water concentrate is essentially self-terminating. If the container were to be left in the sink during the duration of its filling with plain water, no further significant amount of soapy water concentrate solution would be created, since there is no longer any water under pressure entering the container to generate currents of water therein, which currents contribute significantly to the dissolving of the soap mass.

It will be recognized by those skilled in the art that the above-described formation of soapy water concentrate is in significant part a result of the commingling and interaction between the semi-solid soap concentrate 40 and the currents of water created in the container by the water stream entering the container 10 under pressure through the inlet aperture 14. The formation of soapy water concentrate resultant from this combination is at a maximum when the water entering the inlet aperture 14 is directed thereto from a faucet, spigot, hose or other pressurized water source. As the water level rises above the height of the upper surface 12, water entering the sink from the faucet or other water source will no longer enter inlet aperture 14 under pressure, and therefore only negligible soapy water concentrate formation will take place after the sink fills to a level above the upper surface 12. For that reason, the process of releasing a controlled dose of soapy water concentrate into the sink by the above-described method is self-terminating, since once the water level rises above the upper level of upper surface 12, soapy water concentrate formation essentially ceases in this way, the introduction of soapy water concentrate is highly controlled, greatly reducing the opportunity for waste by the user or for overdosing the wash water with too high a concentration of detergent.

In a currently preferred embodiment, the container 10 is a cylinder having a height of approximately $4\frac{7}{8}''$ and circular base having a diameter of approximately $2\frac{5}{8}''$. Inlet aperture 14 is predeterminately circularly shaped with a diameter of approximately $\frac{3}{4}''$, and outlet apertures 16 are predeterminately configured as circular bores each having a diameter of approximately $\frac{1}{4}''$. The container is filled with approximately 455 grams of semi-solid soap concentrate of a type previously described above and, when used in institutional sinks having capacities in the 10 to 20 gallon range, most typically 15 gallons, a device so configured will provide approximately 15 sinks full of adequately-dosed soapy water for use in institutional pot, pan and dishwashing applications.

Referring now to FIG. 6, there is shown an alternate embodiment of the controlled release soap dispenser of the present invention. In this alternate embodiment, the outlet apertures 16 are formed in the sidewall 30 as opposed to the upper surface 12 and, more particularly, in the upper portion of sidewall 30 closely proximate the upper surface 12. The outlet apertures 16 are uniformly spaced about the container 10 along sidewall 30 and, in similar fashion to the embodiment of FIG. 1, provide multiple outlet paths for the water entering through the inlet aperture 14 so as to reduce splashing and spraying of the soapy water concentrate exiting the container 10 through the outlet apertures. The method of use of the container 10 as configured in the alternate manner of FIG. 6 is the same as that described above for the embodiment of FIG. 1.

Figure 3:
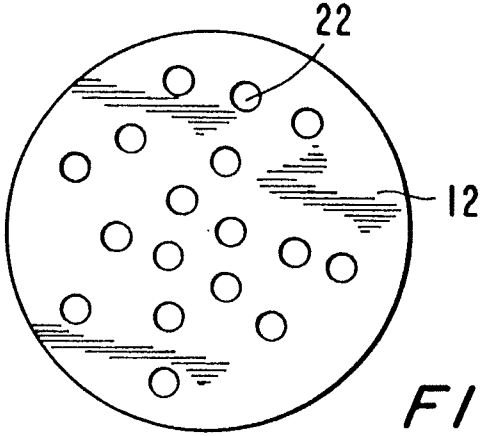
FIG. 3 is a top plan view of an alternate embodiment of the inventive device depicting an alternate aperture arrangement.

In another alternate, depicted in FIG. 3, the upper surface 12 is configured to contain a plurality of combined inlet/outlet apertures 22. In use, the container 10 of FIG. 3 is placed in the sink as described above, and the upper surface 12 is located and oriented so that a portion of its surface containing apertures 22 lies beneath the flow of water from the faucet or other incoming source. Water then enters through those apertures 22 which lie beneath the water source, and the remaining apertures 22 form the outlet apertures for the soapy water concentrate. In this FIG. 3 embodiment, the exact placement of the device beneath the water source is less critical since there is no single inlet aperture through which the water source must be directed; however, a drawback of this alternate arrangement is that it is prone to splashing since not all of the water from the faucet or like source will enter the container interior through a single aperture but, rather, some will be deflected by the non-apertured portion of the upper surface 12 which is struck by the water.

With reference now to FIGS. 5 and 7, there are shown two additional alternate embodiments, similar to those depicted in FIGS. 1 and 6, respectively, but including the additional feature of a series of weep holes 32 arranged vertically along the sidewall 30. The weep holes 32 are configured in a substantially linear pattern and extend in a longitudinal direction from upper surface 12 to the flat base 18 along the sidewall 30. The weep holes 32 are specifically provided so that upon removal of the container 10 from a sink after filling of the sink with soapy water, water remaining within the container 10 will automatically drain through the weep holes 32 without inversion of the container, thereby preventing water retention within the container and undesired dissolving of the semi-solid soap concentrate 40 during periods of nonuse.

It will be recognized by those skilled in the art that the overall height of the container 10 may be predeterminately varied to accommodate different sink sizes, and that a smaller container of lesser height may be used in certain institutional applications where sink space is limited, such as bars, ice cream and soda fountains, and the like. Likewise, a taller container may be utilized for larger sink sizes, so that the duration and volumetric extent of formation of soapy water concentrate is commensurately longer to accommodate a sink of higher capacity. In addition, the concentration of soapy water ultimately yielded may be varied by the user by varying the water pressure and/or the temperature of the water to suit individual application needs. Typical water temperatures for institutional pot and pan washing application averages in a range between approximately 100° to 140° F., while typical water pressures encountered in institutional dishwashing sink runs froms approximately 12 to 30 pounds. The end user, by selectively varying the water pressure and temperature, may accordingly vary the quantity of soapy water concentrate formed in the container and entering the sink, thereby varying the ultimate detergent level in the sink as required to suit that user's particular requirements.

Thus, while there have been shown and described and pointed out fundamental novel features of the invention as applied to preferred embodiments thereof, it will be understood that various omissions and substitutions and changes in the form and details of the disclosed invention may be made by those skilled in the art without departing from the spirit of the invention. It is the intention, however, therefore, to be limited only as indicated by the scope of the claims appended hereto.

What is claimed is:

1. A device for the controlled delivery of a soapy water liquid concentrate solution to a sink as the sink is filled by a stream of water from a source of fill water, the device comprising:

a container having a base predeterminately configured so as to allow said container to be placed in a stationary operative position within the sink beneath the source of fill water and in the path of the stream of water;

said container containing a predetermined quantity of water soluble, semi-solid detergent, said detergent comprising a substantially homogeneous, malleable mass of high density, semi-solid detergent, said mass being substantially affixed to an interior surface of said container and having an exposed surface portion within said container, said exposed surface being exposed to said stream of fill water entering said container through said first aperture;

said container having a first aperture defined therethrough in spaced relation to said base, said first aperture being predeterminately sized and oriented such that when said container is in said operative position, the stream of water from the source of fill water enters said container through said first aperture and agitates against said exposed surface and commingles with said semi-solid detergent in the container so as to dissolve a predetermined fractional quantity of the semi-solid detergent in the fill water entering the container and thereby form a soapy water liquid concentrate;

said container having a height defined by the spacing between said base and said first aperture;

said container having defined therethrough a second aperture from which said soapy water concentrate is ejected from the container by increased pressure developed within the container in response to the entry of the stream of fill water into the container through said first aperture, said ejection gradually filling the sink with the ejected soapy water concentrate; and said container height being selected such that when the sink is filled to a level in excess of the height of said container, said agitation of the fill water within the container substantially ceases and said ejection of soapy water liquid concentrate through said second aperture substantially ceases so that, upon further filling of the sink with water from the fill source, the soapy water concentrate in the sink is diluted to a desired soap concentration level.

2. The device according to claim 1, wherein said base is formed of a substantially flat region on a surface of said container, said base being configured to permit said container to stand freely within the sink in the path of the stream of fill water.

3. The device according to claim 2, wherein said container further comprises an upper surface in oppositely spaced relation to said base.

4. The device according to claim 3, wherein said first aperture and said second aperture are defined through said upper surface.

5. The device according to claim 4, wherein said first aperture is disposed proximate to said second aperture on said upper surface.

6. The device according to claim 4, further comprising a weep hole defined through a surface of said container, said weep hole being disposed such that upon removal of said container from said sink, water remaining in said container is permitted to drain from said container through said weep hole while said container is non-inverted.

7. The device according to claim 4, wherein said first aperture and said second aperture comprise a plurality of equally dimensioned circular openings defined through and randomly disposed on said upper surface.

8. The device according to claim 3, wherein said container is dimensioned as a cylinder, said cylinder having at one end plane said base and at an opposite end plane said upper surface, and having as a cylinder body a continuous side wall.

9. The device according to claim 8, wherein said first aperture and said second aperture are defined through said upper surface.

10. The device according to claim 9, wherein said first aperture is disposed proximate to said second aperture on said upper surface.

11. The device according to claim 9, further comprising a weep hole defined through said container side wall, said weep hole being disposed such that upon removal of said container from said sink, water remaining in said container is permitted to drain from said container through said weep hole while said container is non-inverted.

12. The device according to claim 11, wherein said first aperture is configured as a circular opening oriented at the approximate center of said upper surface, said second aperture comprising a plurality of circular openings disposed circumferentially around and concentric to said first aperture.

13. The device according to claim 11, wherein said weep hole comprises a plurality of circular openings defined through said container side wall and disposed in a linear pattern, said pattern extending longitudinally along said side wall from a point proximate said upper surface to a point proximate said base.

14. The device according to claim 8, wherein said first aperture is configured as a circular opening oriented at the approximate center of said upper surface, said second aperture comprising a plurality of circular openings defined in said cylinder side wall proximate said upper surface and disposed circumferentially around and concentric to said first aperture.

15. The device according to claim 14, further comprising a weep hole defined through said container side wall, said weep hole being disposed such that upon removal of said container from said sink, water remaining in said container is permitted to drain from said container through said weep hole while said container is non-inverted.

16. The device according to claim 15, wherein said weep hole comprises a plurality of circular openings defined through said container side wall and disposed in a linear pattern, said pattern extending longitudinally along said side wall from a point proximate said upper surface to a point proximate said base.

17. A method for the controlled delivery of a soapy water liquid concentrate solution to a sink as the sink is filled by a stream of water from a source of fill water, the method comprising the steps of:

(a) positioning a container having a base and containing a predetermined quantity of a water-soluble, substantially homogeneous, malleable mass of high density, semi-solid detergent in a stationary operative position within the sink to be filled With soapy water beneath the source of fill water;

(b) directing a stream of fill water from the fill water source toward a first aperture defined in and through said container at a location spaced frown the container base, the spacing between the base and the first aperture defining a height of the container, said first aperture being predeterminately sized and oriented so that when said container is in said operative position, the stream of water from the source of fill water enters the container through the first aperture and agitates against and commingles with the semi-solid detergent so as to dissolve a predetermined fractional quantity of the semi-solid detergent in the fill water entering the container and thereby form a soapy water liquid concentrate;

(c) continuing to direct the stream of fill water toward and through the first aperture so as to cause the ejection of the soapy water concentrate from a second aperture defined in the container and through which the soapy water concentrate is ejected from the container by increased pressure developed in the container as a result of the entry of fill water through said first aperture so that said ejection gradually fills the sink with the ejected soapy water liquid concentrate;

(d) allowing the sink to fill with the soapy water concentrate from the container to a level in excess of the height of said container such that agitation of the fill water within the container substantially ceases and said ejection of soapy water liquid concentrate through said second aperture substantially ceases; and (e) predeterminately diluting the soapy water concentrate in the sink to a desired working dilution by further filling the sink beyond the level of step (d) to a working water level with water from the fill source.

18. The method of claim 17, further comprising the step of removing the container from the sink after step (d) is completed.

19. The method of claim 18, wherein said step (e) further comprises predeterminately diluting the soapy water concentrate in the sink by continuing to direct the stream of fill water from the fill water source toward the container first aperture so as to add additional fill liquid to the soapy water concentrate in the sink without substantially increasing the volume of soapy water concentrate in the sink, the first aperture and semi-solid soap being disposed in the container so that the ejection of soapy water concentrate from the container substantially ceases when the sink is filled beyond the level substantially corresponding to the height of the container.

20. A device for the controlled delivery of a soapy water liquid concentrate solution to a sink as the sink is filled by a stream of water from a source of fill water, the device comprising:

a substantially sealed container having an upper surface and a base, said base being configured to permit said container to stand freely on said base in a stationary, operative position in a sink beneath a stream of water from a source of fill water;

a substantially homogeneous, malleable mass of semi-solid detergent disposed in and substantially affixed to an interior surface of said container and having an exposed surface portion within said container;

said upper surface having defined therethrough an inlet aperture located in spaced apart relation to said base and of a predetermined size sufficient to permit entry of a stream of fill water directed at and into said container through said inlet aperture so that said directed stream of fill water entering said container through said inlet aperture creates water currents in said container and said water currents cause agitation of the fill water against the exposed surface potion of said detergent mass, causing the fill water to interact and commingle with and dissolve a portion of said semi-solid detergent mass to form a soapy water liquid concentrate;

said upper surface having defined therethrough a plurality of outlet apertures proximate said inlet aperture from which said soapy water liquid concentrate is ejected from the container by increased pressure developed within the container as a result of said entry of said directed stream of fill water through said inlet aperture so as to gradually fill the sink with the ejected soapy water liquid concentrate from the container;

said container having a height defined by the spacing between the base and the inlet aperture; and said container height being selected, and the relationship of said inlet aperture, said outlet apertures and said detergent mass being selected, such that as the sink gradually fills with said soapy water concentrate to a level in excess of the height of said container, agitation of the fill water within the container substantially ceases and said ejection of soapy water liquid concentrate through said outlet apertures substantially ceases so that, as the stream of fill water from the fill water source continues to be directed toward the inlet aperture, further formation of said soapy water liquid concentrate substantially terminates, and the further filling of the sink with fill water from said fill source dilutes the soapy water concentrate in the sink to a desired soap concentration level.

21. The device according to claim 20, further comprising a weep hole defined through a surface of said container, said weep hole being disposed such that upon removal of said container from said sink, water remaining in said container is permitted to drain from said container through said weep hole without requiring inversion of said container.

22. The device according to claim 21, wherein said first aperture is configured as a circular opening oriented at the approximate center of said upper surface, said second aperture comprising a plurality of circular openings disposed circumferentially around and concentric to said first aperture.

23. The device according to claim 22, wherein said weep hole comprises a plurality of circular openings defined through said container side wall and disposed in a linear pattern, said pattern extending longitudinally along said side wall from a point proximate said upper surface to a point proximate said base.

24. The device according to claim 20, wherein said container is dimensioned as a cylinder, said cylinder having at one end plane said base and at an opposite end plane said upper surface, and having as a cylinder body a continuous side wall.

25. The device according to claim 20, wherein said first aperture and said second aperture comprise a plurality of equally dimensioned circular openings defined through and randomly disposed on said upper surface.

* * * * *